United States Patent [19]

Stinnertz

[11] Patent Number: 4,966,022

[45] Date of Patent: Oct. 30, 1990

[54] METHOD AND APPARATUS FOR LUBRICATING THE MANDREL UPON THE MANUFACTURE OF SEAMLESS TUBES BY THE COLD PILGER PROCESS

[75] Inventor: Horst Stinnertz, Willich, Fed. Rep. of Germany

[73] Assignee: Mannesmann Aktiengesellschaft, Düsseldorf, Fed. Rep. of Germany

[21] Appl. No.: 449,596

[22] Filed: Dec. 12, 1989

[30] Foreign Application Priority Data

Dec. 23, 1988 [DE] Fed. Rep. of Germany ..... 3844163

[51] Int. Cl.[5] ..... B21B 45/02

[52] U.S. Cl. ..... 72/41; 72/208; 72/214

[58] Field of Search ..... 72/41, 43, 44, 208, 72/214

[56] References Cited

U.S. PATENT DOCUMENTS 3,783,663 1/1974 Prajsner et al. ..... 72/41

4,658,617 4/1987 Peytavin ..... 72/44

*Primary Examiner*—Lowell A. Larson

*Assistant Examiner*—T. C. Schoeffler

*Attorney, Agent, or Firm*—Cohen, Pontani & Lieberman

[57] ABSTRACT

A method and apparatus for manufacturing seamless metal tubes by the cold pilger process permitting the continuous feeding of fresh cooling and lubricating agent between the mandrel and inner surface of the material being rolled. The apparatus includes a roll stand including tapering calibrated rolls (2) which is reciprocatingly movable in the direction of rolling at a predetermined stroke to define a reduction zone, the rolls (2) rolling with alternating direction of rotation over the material (3) being rolled and a tapering mandrel (1) inside the material for reducing the diameter and wall thickness of the material, wherein at least one of the rolls (2) and the mandrel (1) has a surface discontinuity within the reduction zone for creating a zone of interruption (6) or an annular gap within which no contact occurs between the material to be rolled (3) and the mandrel (1).

7 Claims, 2 Drawing Sheets

METHOD AND APPARATUS FOR LUBRICATING THE MANDREL UPON THE MANUFACTURE OF SEAMLESS TUBES BY THE COLD PILGER PROCESS

TECHNICAL FIELD

The present invention relates to a method and an apparatus for lubricating the mandrel during the production of seamless metal tubes by the cold pilger process, and particularly to a method and apparatus having a roll stand which is reciprocatingly moveable in rolling direction and including tapering calibrated rolls which roll with alternating direction of rotation over the material being rolled and within which material is placed a tapering mandrel, thereby reducing the diameter and wall thickness of the tube.

BACKGROUND ART

Cold pilger processes are known having a shaping of the roll calibration of the roll mandrel in the manner that diameter and course of the reduction in the wall proceed without interruption along a continuous curve. Methods are also known in which a reduction in diameter without mandrel contact is first effected and then predominantly a reduction of the wall. Furthermore, methods are described by which special re-shaping steps, for instance widening, are carried out in different re-shaping zones.

The methods of the prior art have the disadvantage that they do not permit the continuous feeding of fresh cooling and lubricating agent into the temporarily opened annular gap between roll mandrel and inner surface of the material being rolled. In other words, the lubricant which passes over the inner surface of the billet into the annular gap is not renewed during the passage of a tube cross-section through the re-shaping zone.

It should also be mentioned that the inner surface of the material being rolled is frequently substantially enlarged by the re-shaping. This can lead to the interruption of the lubricating film. Furthermore, in the case of large rolling outputs, the lubricating action can collapse entirely since, with certain tube materials, the development of heat is considerably increased by the re-shaping work. The result is a welding together of the tube and mandrel, leading to rejected tubes.

Additions of solids to the lubricant are intended to reduce the problem, but they lead to expensive methods of cleaning. The prior art is also unsatisfactory ecologically inasmuch as chlorine-paraffin oils are generally used for the rolling of the tube materials, so that any further development leading to better lubricating conditions should include the replacement of the presently used chlorine-paraffin oils by less objectionable products.

European Pat. No. 01 48 806, discloses a method permitting a feed of fresh oil into the temporary gap between the material being rolled and the roll mandrel. The disclosed method has the disadvantage that, for the stated purpose, the mandrel must be moved back and then forward upon each stroke of the stand, or that seals which are subject to injury are provided within the inside of the billet or tube.

SUMMARY OF THE INVENTION

Proceeding from the prior art and the problems described above, an object of the present invention is to improve the feeding of lubricating and cooling agent into the rolling gap formed between the mandrel and the material being rolled. This object is achieved by providing a method of manufacturing seamless metal tubes by the cold pilger process wherein a roll stand including tapering calibrated rolls is reciprocatingly movable in the direction of rolling at predetermined stroke to define a reduction zone, the rolls rolling with alternating direction of rotation over the material being rolled and a tapering mandrel inside said material for reducing the diameter and wall thickness of said material, said method comprising interrupting said reduction in diameter and wall thickness to form an annular gap in a reduction-free zone between said mandrel and said material to be rolled; and introducing a cooling and lubricating agent into said annular gap of said reduction-free zone.

The apparatus of the present invention for the manufacturing of seamless metal tubes by the cold pilger process also includes a roll stand including tapering calibrated rolls and which is reciprocatingly movable in the direction of rolling at a predetermined stroke to define a reduction zone, the rolls rolling with alternating direction of rotation over the material being rolled and a tapering mandrel inside said material for reducing the diameter and wall thickness of said material, comprising at least one of said rolls and said mandrel having a surface discontinuity within said reduction zone for generating a zone of interruption within which no contact occurs between said material to be rolled and said mandrel.

By interrupting the reduction during a rolling stroke, lubricant can be introduced into the annular gap formed between mandrel and the inner surface of the material being rolled without interrupting the stroke before the reduction is continued. Ecologically injurious lubricant additives can be dispensed with, since lubricating and cooling action is considerably improved by the measure in accordance with the invention as compared with the known solutions.

BRIEF DESCRIPTION OF THE DRAWINGS

One embodiment of the invention will be described in further detail with reference to the drawings, in which.

DETAILED DESCRIPTION OF THE PRESENTLY PREFERRED EMBODIMENT

Figure 1:
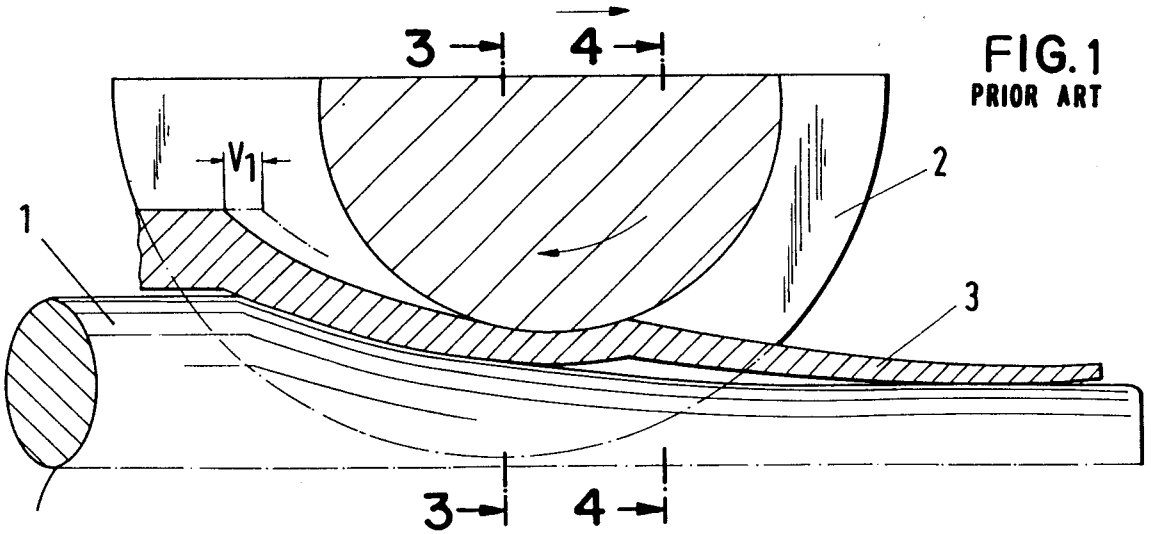
FIG. 1 PRIOR ART
FIG. 1 shows diagrammatically the rolling conditions on the forward stroke of a roll stand in accordance with the prior art.
Figure 4:
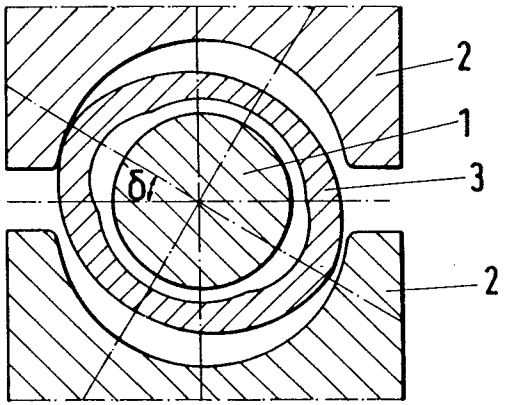
Figure 3:
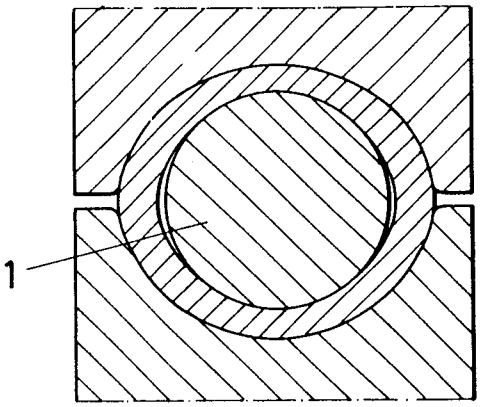

FIG. 1 diagrammatically shows the rolling conditions on the forward stroke of the roll stand in accordance with the prior art. The material 3 being rolled is reduced in diameter and wall thickness between the roll mandrel 1 and the rolls 2. The sections through the entrance plane (Section C-D) and the exit plane (Section A-B) show, for the forward stroke, that the annular gap is substantially closed behind the re-shaping zone and is open in front of the re-shaping zone.

After the billet has advanced $V_1$ in at least one dead point of the stand, the annular gap opens over the entire length of the re-shaping zone. It is clearly not possible to provide the roll mandrel with lubricating holes which would not be contacted at some time by the material being rolled and thus lead unavoidably to weldings together and surface damages.

Figure 2:
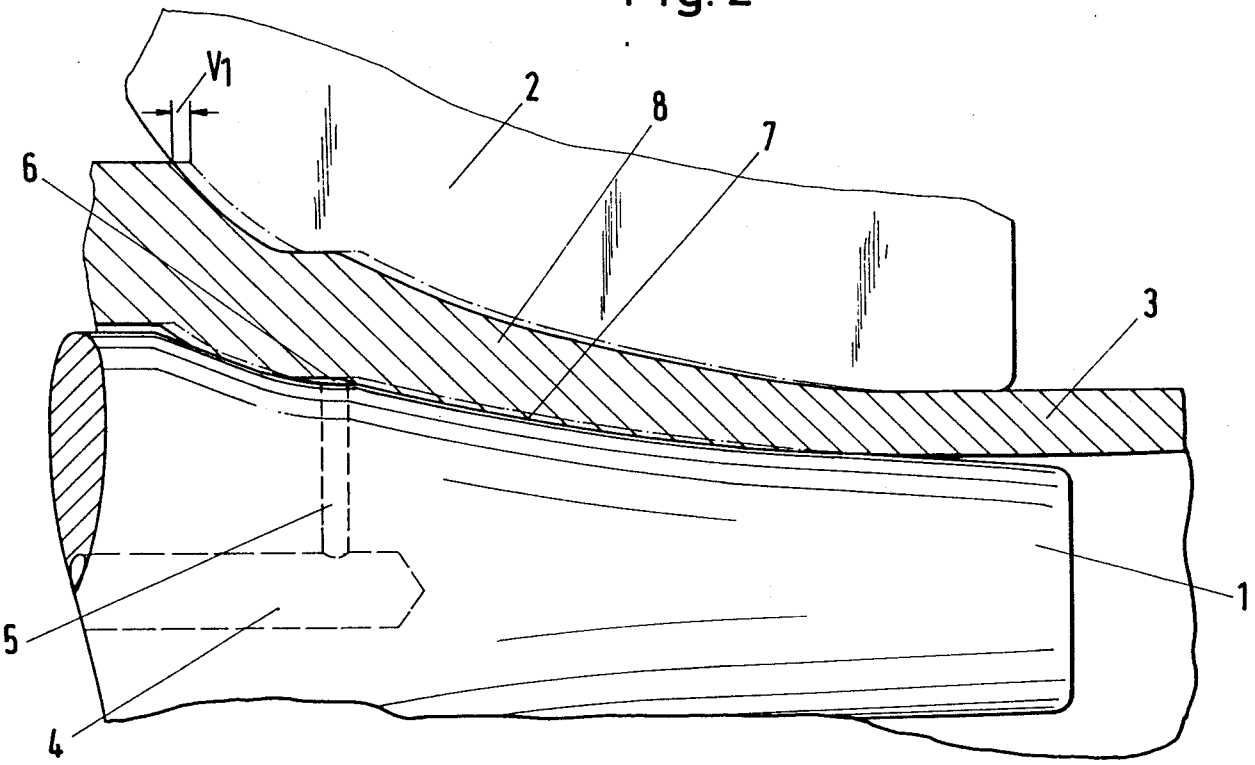
FIG. 2 diagrammatically shows the re-shaping zone of the present invention.

FIG. 2 shows diagrammatically, by way of example, that the re-shaping zone is interrupted by a zone in which no reduction occurs in accordance with the present invention so that a continuous annular gap is formed between mandrel 1 and material 3 to be rolled which permits the feeding of cooling and lubricating agent into said gap. As shown in FIG. 2, roll 2 is provided with a surface discontinuity within the reduction zone representing a protrusion which deviates from the regular shape of the roll surface. Mandrel 1 is also provided with a surface discontinuity, an indentation, within the reduction zone cooperating with said surface discontinuity of the roll whereby an annular hollow space or interruption zone 6 is formed between the mandrel 1 and tube 3. The length of the annular hollow space or interruption zone 6 is preferably between at least about 2% and at most about 10% of the stroke of the stand. As is also shown, the annular hollow space or interruption zone 6 forming a reduction-free zone is located in the first third of the total reduction zone of the stroke of the roll stand. Due to the discontinuous surface of the cooperating mandrel 1 and roll 2, the annular gap 6 or zone of interruption of the reduction zone, i.e. a reduction-free zone, is formed within which zone there is no contact between the material to be rolled 3 and mandrel 1 thereby providing a space in which the cooling and lubricating agent can be introduced. For the introduction of the cooling and lubricating agent, there is provided in mandrel 1 preferably an axial bore 4 which is connected to a bore 5, preferably transverse thereto and leading to the outer surface of the mandrel and into the region of the zone of interruption 6. For the feeding of the cooling and lubricating agent a connecting means, preferably a known rotary connection is provided between a cooling unit and the mandrel. In case a plurality of alternately operating mandrels are used, a plurality of rotary connections is provided. Cooling and lubricating agent is fed continuously under pressure through the hole 4 which continues into the mandrel rod and is fed via the radial holes 5 to the annular hollow space (interruption zone 6). After the billet advance $V_1$, an annular gap 7 is formed between the advanced material 8 (dot-dash line) and the material being rolled, through which the cooling and lubricating agent can distribute itself over the caliber length. By the rolling process, the annular gap is increasingly closed upon the advance in rolling direction so that the cooling and lubricating agent will flow exclusively or predominantly in the direction of rolling. On the return stroke, conversely, the gap will be increasingly closed opposite the direction of rolling so that the stream of cooling and lubricating agent is also directed backward. Assurance is thus had that fresh, cold cooling and lubricating agent is active over the entire re-shaping length.

Since these as well as further embodiments and modifications thereto are intended to be within the scope of the present invention, the above description should be construed as illustrative and not in a limiting sense, the scope of the invention being defined only by the following claims.

What is claimed is:

1. A method of manufacturing seamless metal tubes by the cold pilger process wherein a roll stand including tapering calibrated rolls is reciprocatingly movable in the direction of rolling at a predetermined stroke to define a reduction zone, the rolls rolling with alternating direction of rotation over the material being rolled and a tapering mandrel inside said material for reducing the diameter and wall thickness of said material, said method comprising:

interrupting said reduction in diameter and wall thickness to form an annular gap in a reduction-free zone between said mandrel and said material to be rolled; and introducing a cooling and lubricating agent into said annular gap of said reduction-free zone.

2. The method according to claim 1, wherein said reduction in diameter and wall thickness is interrupted to form a reduction-free zone over a length of between about 2% and about 10% of said stroke.

3. The method according to claim 1, wherein said reduction-free zone is formed in the first third of said reduction zone of said stroke of said stand.

4. An apparatus for the manufacturing of seamless metal tubes by the cold pilger process wherein a roll stand including tapering calibrated rolls is reciprocatingly movable in the direction of rolling at a predetermined stroke to define a reduction zone, the rolls rolling with alternating direction of rotation over the material being rolled and a tapering mandrel inside said material for reducing the diameter and wall thickness of said material, comprising:

at least one of said rolls (2) and said mandrel (1) having a surface discontinuity within said reduction zone for causing a zone of interruption (6) within which no contact occurs between said material to be rolled (3) and said mandrel (1).

5. The apparatus according to claim 4, wherein said mandrel (1) has an outer surface and an axial bore (4); and at least one bore (5) connected to said axial bore and leading to said outer surface of said mandrel (1) in the region of said zone of interruption (6).

6. The apparatus according to claim 4, additionally comprising a cooling unit and a connecting means between said cooling unit and said mandrel (1) for feeding said cooling and lubricating agent into said mandrel (1).

7. The apparatus according to claim 6, wherein said connecting means comprises a rotary connection.

* * * * *

UNITED STATES PATENT AND TRADEMARK OFFICE

CERTIFICATE OF CORRECTION

PATENT NO. : 4,966,022

DATED : October 30, 1990

INVENTOR(S) : STINNERTZ, Horst

It is certified that error appears in the above-identified patent and that said Letters Patent is hereby corrected as shown below:

Column 1, line 20, delete "having" and replace with --which have-- and delete "shaping" and replace with --shape--.

Column 1, line 21, delete "roll calibration" and replace with --calibration roll and--, delete "in the manner" and replace with --such--.

Column 1, line 22, after "that" insert --the--.

Column 1, line 23, delete "proceed" and replace with --proceeds--.

Column 1, line 31, after "of" insert --a--.

Column 1, line 33, after "between" insert --the-- and after "and" insert --the--.

Column 1, line 44, after "entirely" insert --,--, and after "since" delete --,-- and after "materials" delete --,--.

Column 1, line 51, after "cally" insert --,--.

UNITED STATES PATENT AND TRADEMARK OFFICE

CERTIFICATE OF CORRECTION

PATENT NO. : 4,966,022

DATED : October 30, 1990

INVENTOR(S) : STINNERTZ, Horst

It is certified that error appears in the above-identified patent and that said Letters Patent is hereby corrected as shown below:

Column 1, line 55, delete "by" and replace with --with--.

Column 1, linc 60, change "The" and replace with --For the stated purpose, the--; delete "disadvantage" and replace with --disadvantages--, and after "that" delete ", for the".

Column 1, line 61, delete "stated purpose,".

Column 1, line 62, delete "that" and replace with --else--.

Column 2, line 1, after "of" insert --a--.

Column 2, line 27, delete "com-".

Column 2, line 28, delete "prising".

Column 2, line 35, after "between" insert --the--.

Column 2, line 36, delete "without interrupting the stroke before the".

Column 2, line 37, delete "reduction is continued" and substitute therefor --before the reduction is continued, without interrupting the stroke--.

UNITED STATES PATENT AND TRADEMARK OFFICE

CERTIFICATE OF CORRECTION

PATENT NO. : 4,966,022

DATED : October 30, 1990

INVENTOR(S) : STINNERTZ, Horst

It is certified that error appears in the above-identified patent and that said Letters Patent is hereby corrected as shown below:

Column 2, line 39, delete "measure" and replace with --measures--.

Column 2, line 60, after "Section" delete "C-D" and replace with --4--.

Column 2, line 61, after "tion" delete "A-B" and replace with --3--.

IN THE ABSTRACT:

Line 3, after "of" insert --a--.

Signed and Sealed this

Twenty-fifth Day of August, 1992

*Attest:*

DOUGLAS B. COMER

*Attesting Officer*

*Acting Commissioner of Patents and Trademarks*